US005765245A

United States Patent [19]

Breto

[11] Patent Number: 5,765,245

[45] Date of Patent: Jun. 16, 1998

[54] PILLOW BOOK CONSTRUCTION

[75] Inventor: Javier Barbed Breto, Plaza San Fransisco 17-7° Centro, E-50006 Zaragoza, Spain

[73] Assignee: Javier Barbed Breto, Zaragoza, Spain

[21] Appl. No.: 663,238

[22] PCT Filed: Oct. 13, 1995

[86] PCT No.: PCT/ES95/00114

§ 371 Date: Aug. 19, 1996

§ 102(e) Date: Aug. 19, 1996

[87] PCT Pub. No.: WO96/12430

PCT Pub. Date: May 2, 1996

[30] Foreign Application Priority Data

Oct. 20, 1994 [ES] Spain ..... 9402187

[51] Int. Cl.[6] ..... A43C 20/02

[52] U.S. Cl. ..... 5/640; 5/636

[58] Field of Search ..... 5/636, 640, 645, 5/634

[56] References Cited

U.S. PATENT DOCUMENTS

| | | | |
|---|---|---|---|
| 3,276,046 | 10/1966 | Capelli | 5/639 |
| 3,319,272 | 5/1967 | Eller | 5/639 |
| 4,280,241 | 7/1981 | Pfaff | 5/640 |
| 4,853,994 | 8/1989 | Ekstein | 5/446 |
| 4,874,340 | 10/1989 | Smallwood | 5/645 |

FOREIGN PATENT DOCUMENTS

| | | | |
|---|---|---|---|
| 2319801 | 10/1973 | Germany | 5/640 |
| 26072 | 12/1909 | United Kingdom | 5/640 |
| 2130085 | 5/1984 | United Kingdom | 5/636 |
| 2168290 | 6/1986 | United Kingdom | 5/640 |

*Primary Examiner*—Flemming Saether
*Attorney, Agent, or Firm*—Hoffmann & Baron, LLP

[57] ABSTRACT

A pillow book construction comprised of two pillows, a thick one and a thin one, joined together like the two covers of a book by means of a seam along the short end of the internal sides. The pillows have thicknesses of 7 cm and 5 cm and, once folded upon each other, form a large pillow-book of 12 cm. This pillow construction with these three values of thickness has been designed taking into account the three sleeping or resting positions: the head and the body sideways; the head sideways and the body facing downwards; the head and body facing upwards. Additionally, a plurality of exchangeable and illustrated sheets made of fabric are provided.

14 Claims, 4 Drawing Sheets

PILLOW BOOK CONSTRUCTION

FIELD OF THE INVENTION

The present invention relates to a pillow book. Specifically, the present invention relates to a pillow book formed by two pillows whose interior sides are illustrated by texts and drawings with pleasant and decorative motifs.

SUMMARY OF THE INVENTION

In accordance with one embodiment of the present invention, the pillow book includes a first pillow and second pillow. The first and second pillows are secured along their side edges by a securing device thereby permitting the first and second pillows to be folded together into a closed position. The first and second pillows each have an interior side including illustrations formed thereon. The securing device includes a fabric ribbon or a zipper with separator. In addition, the pillow book may include a plurality of fabric leaves having illustrations thereon secured to the fabric ribbon.

Furthermore, in a preferred embodiment the first pillow has a thickness greater than the thickness of the second pillow and when the first pillow is folded onto the second pillow, the pillow book has a total thickness approximately equivalent to the sum of the thickness of the first and second pillows. Therefore, the pillow book has adjustable values of thickness thereby permitting the pillow book to comfortably accommodate a user's head in a variety of resting positions.

DETAILED DESCRIPTION OF THE PREFERRED EMBODIMENT

Figure 1:
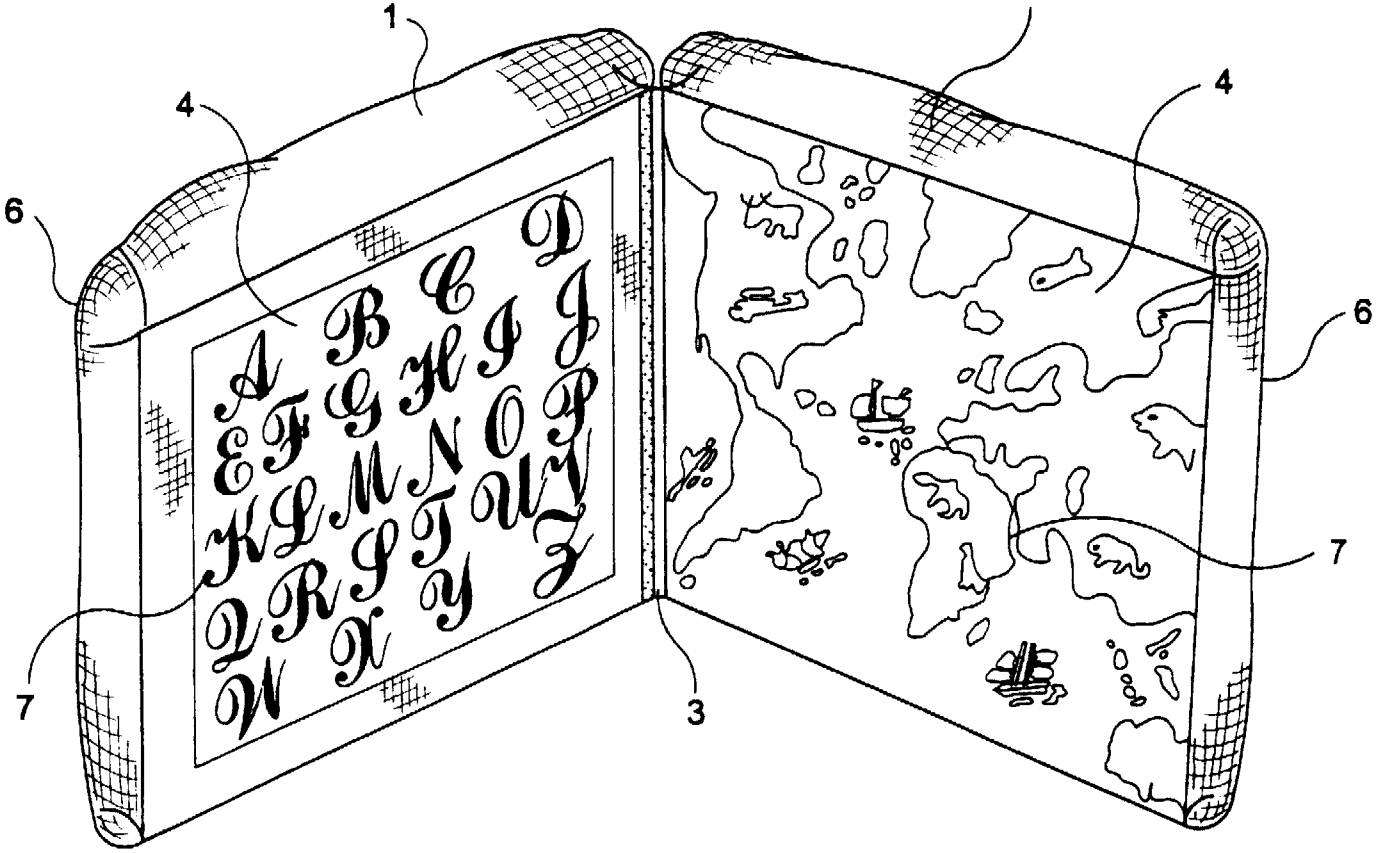
FIG. 1 is a perspective view of the pillow book of the present invention.
Figure 3:
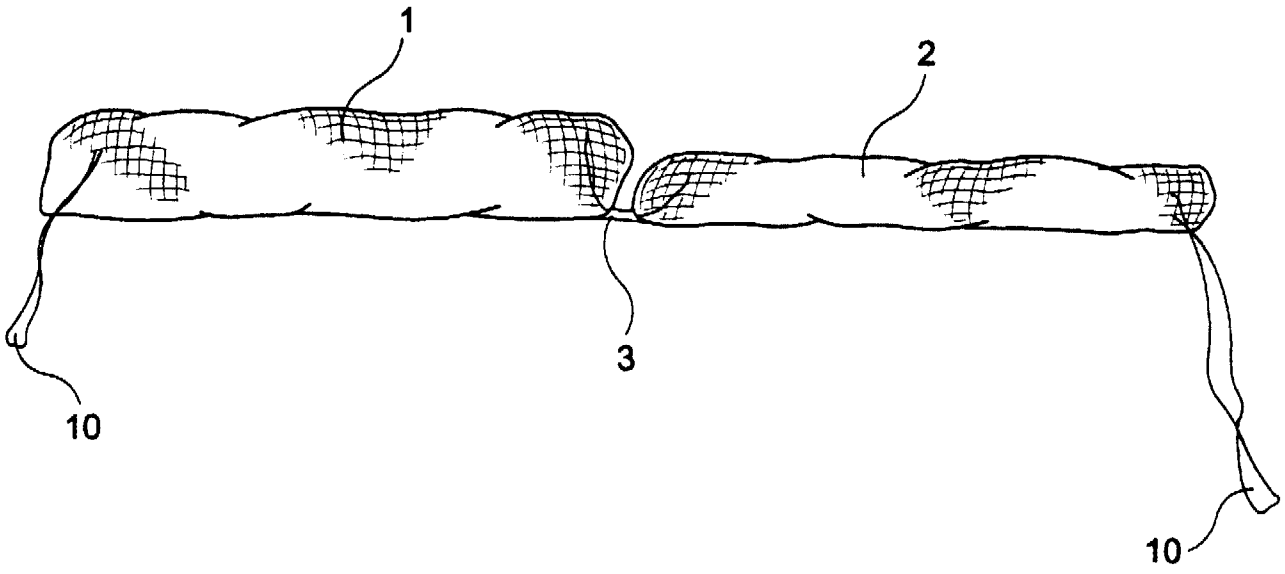
FIG. 3 is an elevational view of the top edge of the pillow book shown in the open position.

Referring initially to FIG. 1, a pillow book 20 of the present invention is shown. Pillow book 20 is a dual pillow structure formed by two pillows 1, 2 joined together along one of their sides, by a fabric ribbon 3. In the preferred embodiment, fabric ribbon 3 is sewn to the interior edges of pillows 1, 2 as shown in FIG. 3. Alternatively, pillows 1, 2 may be joined together by a zipper with separator, or by other conventional means. Pillows 1, 2 are so joined such that upon folding the two pillows they close in a similar way to a book. Pillows 1, 2 may also include text and drawings 7, such as a map and alphabet, formed on the interior sides 4 of the two pillows 1, 2.

Figure 2:
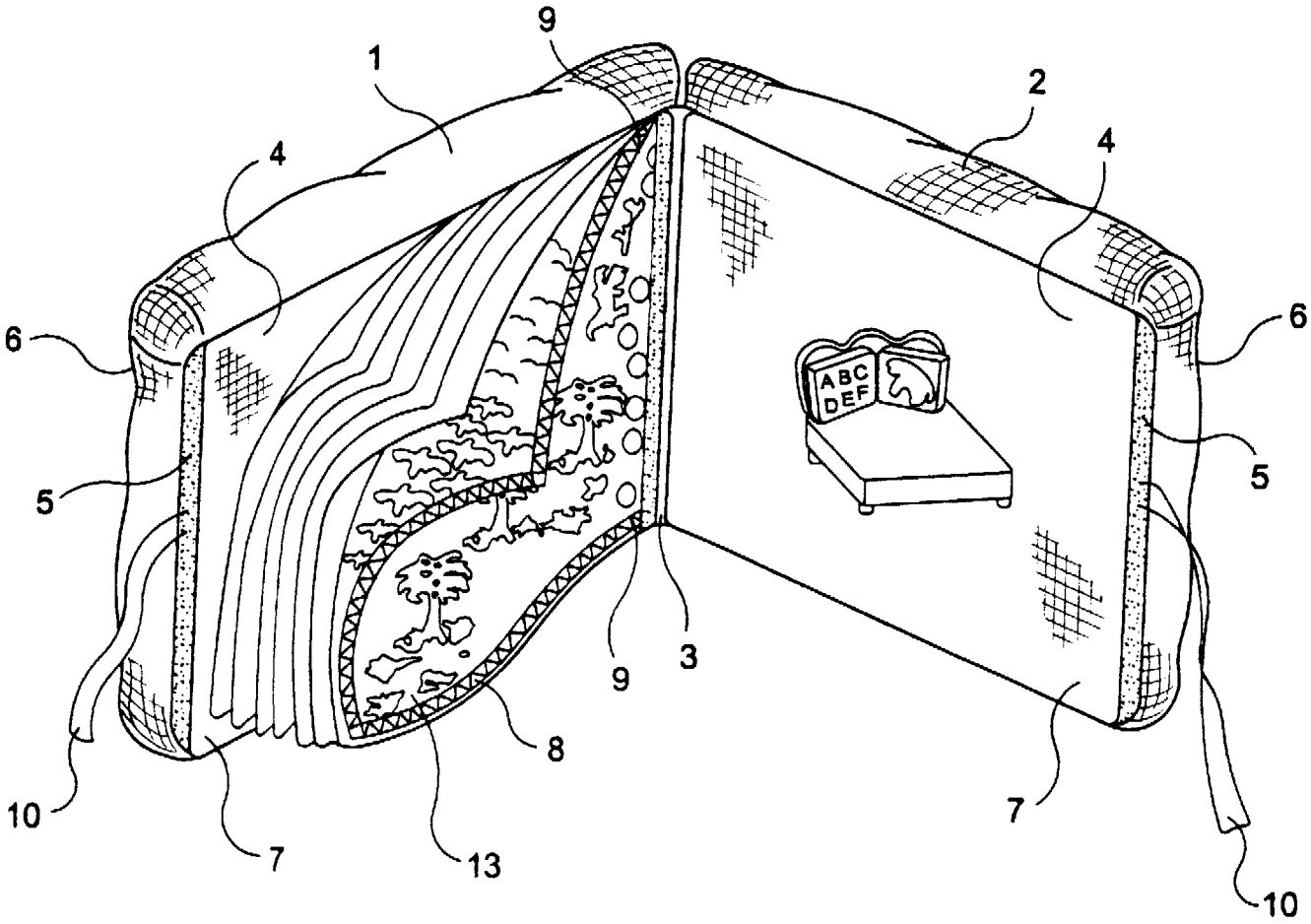
FIG. 2 is a perspective view of the pillow book including a plurality of fabric leaves.

Referring additionally to FIG. 2, pillow book 20 may also include several fabric leaves 8 illustrated with texts and drawings with decorative and pleasant motifs 13. The fabric leaves 8 may be secured to pillows 1, 2 by fabric ribbon 3 which also secures pillows 1, 2 together.

Figure 5:
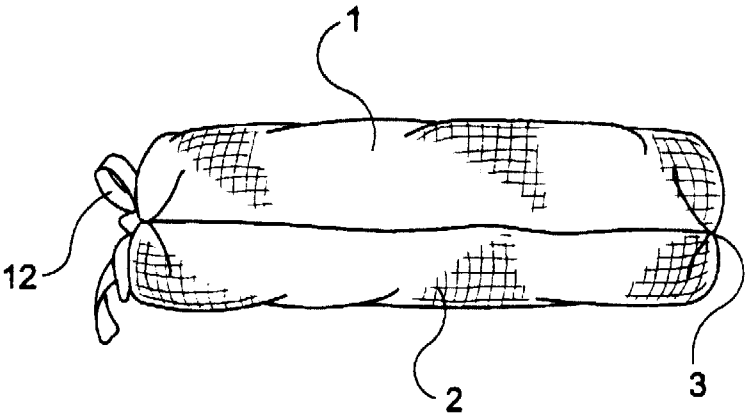
FIG. 5 is an elevational view of the top edge of the pillow book shown in the closed position.

In order to secure pillow book 20 in the closed position, pillow book 20 may further include laces of fabric 10 sewn on the external ends of the interior sides 4 of the pillows 1, 2. As shown in FIG. 5, the laces 10 may be tied together 12 when the pillow book is in the closed position thereby securing pillow book 20 in the closed position. Additionally, strips of VELCRO 5 may be secured to the exterior edges of pillows 1, 2 such that when pillow book 20 is closed, the VELCRO strips 5 will engage each other thereby maintaining pillow book 20 in the closed position.

In the preferred embodiment shown in FIGS. 3 and 5, pillow 1 has a thickness greater than pillow 2. Pillow 1 preferably has thickness of 7 cm, and pillow 2 preferably has a thickness of 5 cm. When pillow book 20 is in the closed position a pillow having a 12 cm thickness is formed. Accordingly, pillow book 20 may be configured to produce three different values of thickness. Each pillow thickness is preferably chosen to comfortably accommodate an individual in the three following positions of sleeping or resting, when they are lying:

With their head and body facing up;

With the side of their head and the body facing down; and

On the side of their head and side of their body.

Pillow book 20 has been developed to be used in each of these three positions.

Figure 4:
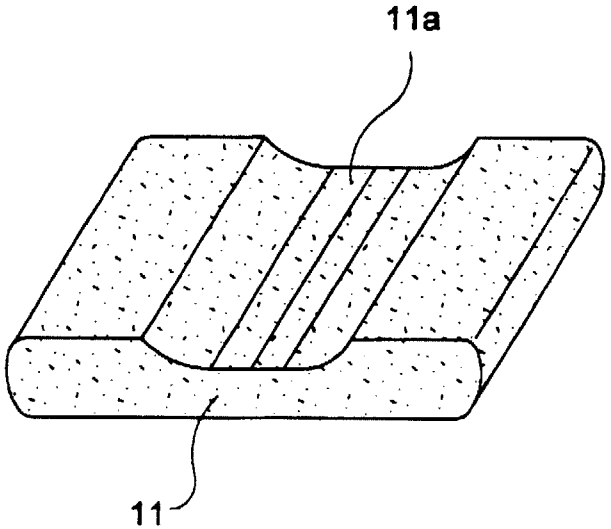
FIG. 4 is a top perspective view of the foam piece of the present invention.

Referring to FIG. 4, the filling of pillows 1, 2 is composed of a foam piece 11 formed of polyurethane which is preferably fireproof. Foam piece 11 is preferably soft on its upper side and sides. Foam piece 11 may optionally have a groove-shaped cavity 11*a* formed therein extending along its length. This grooved cavity 11*a* provides a space into which one's ear may extend when lying on pillow book 20. Cavity 11*a*, therefore, causes the ear to receive less pressure resulting in more comfortable support.

Pillows 1, 2 are each formed by covering foam piece 11 with a lining fabric 6.

Optionally, pillows 1, 2 can be made having different thickness and measures, in order to accommodate children and adults.

In an alternative embodiment (not shown), a fabric sheath may be employed to cover the outsides of the two pillows 1, 2, as well as their sides. Fabric sheath takes the shape of two rectangular basins fixed to the center by the upper part of their short side. The fabric sheath has two bags, one on each end of the two basins, and in the center between the two basins two ribbons fixed one on each side. After putting pillows 1, 2 within sheath, these ribbons are crossed to the interior sides of the pillows and bound with a loop.

I claim:

1. A pillow construction comprising:

at least a first and second pillow each having a secured side edge and an oppositely disposed free edge; and means for pivotally securing said first and second pillows together along said secured side edges and permitting said first and said second pillows to be folded together into a closed position;

at least one fabric leaf having indicia thereon being secured to said pillow construction adjacent said first and second pillow secured side edges, said at least one fabric leaf being positioned between said first and second pillows when folded into said closed position; and wherein said first pillow includes a first thickness value and said second pillow includes a second thickness value, said first thickness value being greater than said second thickness value, and said pillow construction in said closed position having a third thickness value, thereby permitting said pillow construction to be used in any one of said first, second and third thickness values to comfortably accommodate a user's head in a variety of resting positions.

2. A pillow construction as set forth in claim 1, wherein said first and second pillows each have an interior side and at least one of said interior sides include information thereon.

3. A pillow construction as set forth in claim 1, wherein said securing means includes a fabric ribbon.

4. A pillow construction as set forth in claim 1, wherein said securing means includes a zipper.

5. A pillow construction as set forth in claim 1, further including a plurality of fabric leaves having indicia thereon, said leaves being secured within said pillow construction by said securing means between said first and second pillows.

6. A pillow construction as set forth in claim 1, wherein said first thickness value is approximately 7 cm and said second thickness value is approximately 5 cm.

7. A pillow construction as set forth in claim 1, wherein said first and second pillows each further include a filling piece formed of cushion material, at least one said pillow filling pieces includes a grooved channel extending along a length of said filling piece, said channel being sized to accommodate the user's ear when resting one's head upon said pillow construction.

8. A pillow construction as set forth in claim 7, wherein said cushion material is covered by a fabric lining.

9. A pillow construction as set forth in claim 7, wherein said cushion material is polyurethane foam.

10. A pillow construction as set forth in claim 7, wherein each of said free edges of said first and second pillows include an elongate lace formed thereon, said laces being securable together when said pillow construction is in said closed position thereby securing said pillow construction in said closed position.

11. A pillow construction as set forth in claim 7, wherein said free edges of said first and second pillows include strips of VELCRO for securing said pillow construction in said closed position.

12. A pillow construction comprising:

a first pillow having a secured side edge and a filling piece formed of a cushion material;

a second pillow having a secured side edge and a filling piece formed of a cushion material;

means for pivotally securing said first and second pillows together along said secured side edges and permitting said first and second pillows to be folded together into a closed position;

a plurality of fabric leaves having indicia thereon being secured to said pillow construction adjacent said first and second pillow secured side edges, said plurality of fabric leaves being positioned between said first and second pillows when folded into said closed position; and said first pillow having a thickness greater than a thickness of said second pillow such that when said first pillow is folded onto said second pillow, said pillow construction has a total thickness approximately equivalent to the sum of the thickness of the first and second pillows, thereby permitting said pillow construction to be used in any one of three thicknesses to comfortably accommodate a user's head in a variety of resting positions.

13. A pillow construction as set forth in claim 12, wherein said means for securing said first and second pillows together includes a fabric ribbon.

14. A pillow construction as set forth in claim 13, wherein at least one of said first and second pillow filling pieces includes a grooved channel extending along a length of said filling piece, said groove being sized to accommodate an individual's ear when they are resting their head upon said pillow construction.

* * * * *